US008966881B2

(12) United States Patent
Nagasawa

(10) Patent No.: US 8,966,881 B2
(45) Date of Patent: Mar. 3, 2015

(54) DEVICE AND METHOD FOR COMBUSTING PARTICULATE SUBSTANCES

(75) Inventor: Takeshi Nagasawa, Utsunomiya (JP)

(73) Assignee: Utsunomiya University, Utsunomiya-shi, Tochigi (JP)

( * ) Notice: Subject to any disclaimer, the term of this patent is extended or adjusted under 35 U.S.C. 154(b) by 433 days.

(21) Appl. No.: 13/321,308

(22) PCT Filed: May 11, 2010

(86) PCT No.: PCT/JP2010/057967

§ 371 (c)(1),
(2), (4) Date: Jan. 31, 2012

(87) PCT Pub. No.: WO2010/134448

PCT Pub. Date: Nov. 25, 2010

(65) Prior Publication Data

US 2012/0124969 A1 May 24, 2012

(30) Foreign Application Priority Data

May 19, 2009 (JP) ..... P2009-120554

(51) Int. Cl.
*F01N 3/00* (2006.01)
*B03C 3/36* (2006.01)
(Continued)

(52) U.S. Cl.
CPC . *B03C 3/363* (2013.01); *B03C 3/41* (2013.01); *B03C 3/49* (2013.01); *F01N 3/01* (2013.01);
(Continued)

(58) Field of Classification Search
CPC ..... B03C 3/363; B03C 3/41; B03C 3/49; B03C 3/64; B03C 2201/30; F01N 3/01; F01N 3/027; F01N 3/0892
USPC ..... 60/274, 275, 311
See application file for complete search history.

(56) References Cited

U.S. PATENT DOCUMENTS 5,698,012 A * 12/1997 Yoshikawa ..... 96/47
5,787,704 A * 8/1998 Cravero ..... 60/274
(Continued)

FOREIGN PATENT DOCUMENTS

EP 1 662 104 A 5/2006
JP H05-096129 A 4/1993
(Continued)

*Primary Examiner* — Thomas Denion
*Assistant Examiner* — Jason Shanske
(74) *Attorney, Agent, or Firm* — Drinker Biddle & Reath LLP

(57) ABSTRACT

It is possible to provide a device and a method for combusting particulate substances which particulate matters discharged from an internal combustion engine can be effectively combusted, and the device configuration is simple and does not become large and heavy. The combustion device has: an introduction portion 8 used to introduce a particulate matter-containing gas 5 discharged from the exhaust port of an internal combustion engine; a charging unit 11 which is provided on the downstream side of the introduction portion 8, and in which all or part of the particulate matters 6' are e negatively charged by bringing the particulate matter-containing gas into contact with; an electric discharge unit 15 which is provided in an insulation pipe 100 which is connected to the downstream side of the charging unit 11, and in which the particulate matters 6', all or part of which are negatively charged, are introduced into a silent discharge area A1 and are combusted with an increased retention time, the silent discharge area being generated between an anode and a cathode; a discharge portion 9 which is connected to the insulation pipe 100 at the downstream side of the electric discharge unit and which discharges the combusted gas; and a power source unit which applies an electric field to the charging unit and the electric discharge unit.

8 Claims, 9 Drawing Sheets

(51) Int. Cl.

| | |
|---|---|
| ***B03C 3/41*** | (2006.01) |
| ***B03C 3/49*** | (2006.01) |
| ***F01N 3/01*** | (2006.01) |
| ***F01N 3/027*** | (2006.01) |
| ***B03C 3/12*** | (2006.01) |
| ***B03C 3/62*** | (2006.01) |
| *F01N 3/08* | (2006.01) |
| *B03C 3/06* | (2006.01) |
| *B03C 3/09* | (2006.01) |
| *B03C 3/47* | (2006.01) |

(52) U.S. Cl.

CPC . *F01N 3/027* (2013.01); *B03C 3/12* (2013.01); *B03C 3/62* (2013.01); *B03C 2201/30* (2013.01); *F01N 3/0892* (2013.01); *B03C 3/06* (2013.01); *B03C 3/09* (2013.01); *B03C 3/47* (2013.01)

USPC ..... 60/275; 60/274; 60/311

(56) References Cited

U.S. PATENT DOCUMENTS

| | | | | |
|---|---|---|---|---|
| 5,956,946 | A * | 9/1999 | Yamada | 60/296 |
| 6,994,830 | B1 | 2/2006 | Raybone et al. | |
| 2005/0194583 | A1 | 9/2005 | Taylor et al. | |
| 2006/0021503 | A1 * | 2/2006 | Thaler | 95/70 |
| 2006/0113181 | A1 | 6/2006 | Hirata et al. | |
| 2006/0156791 | A1 * | 7/2006 | Tikkanen et al. | 73/23.33 |
| 2006/0187609 | A1 * | 8/2006 | Dunn | 361/230 |
| 2008/0056934 | A1 | 3/2008 | Tsui | |
| 2010/0072055 | A1 | 3/2010 | Tanaka et al. | |

FOREIGN PATENT DOCUMENTS

| | | | |
|---|---|---|---|
| JP | H08-112549 | A | 5/1996 |
| JP | 2002-263523 | A | 9/2002 |
| JP | 2003-172123 | A | 6/2003 |
| JP | 2004-514820 | A | 5/2004 |
| JP | 2005-106022 | A | 4/2005 |
| JP | 2005-337153 | | 12/2005 |
| JP | 2007-021380 | A | 2/2007 |
| JP | 2007-187136 | | 7/2007 |
| JP | 2008-64015 | | 3/2008 |
| JP | 2009-50840 | | 3/2009 |
| WO | WO-02/42615 | A1 | 5/2002 |
| WO | WO 2008/006981 | A | 1/2008 |
| WO | WO 2008/062554 | A | 5/2008 |

* cited by examiner

DEVICE AND METHOD FOR COMBUSTING PARTICULATE SUBSTANCES

FIELD OF THE INVENTION

The present invention relates to a device and a combustion method for combusting particulate matters in which particulate matters discharged from an internal combustion engine can be effectively combusted.

BACKGROUND ART

A variety of techniques have been studied to remove particulate matters (PM) in exhaust gas discharged from an internal combustion engine. In Patent Document 1, a technique is proposed in which particulate matters are captured by a ceramic honeycomb filter, and when the amount of the captured particulate matters exceeds the predetermined acceptable value, the captured particulate matters are heated to be combusted away. In Patent Document 2, in order to overcome the drawback that the ceramic honeycomb filter used in Patent Document 1 is expensive, fragile and hard to handle, and in order to decrease the power consumption required for burning away particulate matters, a technique is proposed in which a combustion heater is placed between a permeable filter made of ceramic fiber and a heat insulator, and heating is performed by using the heater to burn particulate matters with a timing controlling the inflow of particulate matter-containing gas.

Since the techniques in the above Patent Documents 1 and 2 are a technique in which particulate matters are captured by a heat resistant filter and the captured particulate matters are heated to be combusted away in an arbitrary timing, there is concern about a reduced filter life due to a rapid temperature change, a local heating or the like. To address such issues, in Patent Document 3, a technique is proposed in which cracking means for cracking without causing a rapid temperature change or a local heating on a filter which captures particulate matters, and oxidizing means for oxidizing the residual combustion particulate matters by ozone gas are combined.

In Patent Document 4, a technique is proposed in which manganese oxide-supported substrate in a gas flow channel is placed and adsorbed particulate matters are oxidatively decomposed, as well as the oxidation decomposition of particulate matters is accelerated by further containing active species such as an OH radical, an oxide atom, oxygen ion and ozone gas. In this technique, particulate matters are charged by electrons generated at the time of discharge in a plasma discharge device so that the adhesion to manganese oxide-supported substrate is accelerated, and the oxidative decomposition of the particulate matters by the catalysis of manganese oxide can be effectively performed, and further, since an OH radical and ozone generated in the plasma discharge device per se oxidatively decompose the particulate matters, the particulate matters can be removed by oxidation.

PRIOR ART REFERENCES

Patent Document

[Patent Document 1] Japanese Laid-Open Patent Application No. 2005-337153

[Patent Document 2] Japanese Laid-Open Patent Application No. 2008-64015

[Patent Document 3] Japanese Laid-Open Patent Application No. 2007-187136

[Patent Document 4] Japanese Laid-Open Patent Application No. 2009-50840

SUMMARY OF THE INVENTION

The Problems Solved by the Invention

However, the technique in the above Patent Document 3 includes a filter which captures and cracks particulate matters and generating means for generating an oxidizing and decomposing gas such as ozone gas, and the technique in the above Patent Document 4 includes a catalytic substrate on which particulate matters are adsorbed and heated to be oxidatively decomposed and generating means for generating an oxidizing and decomposing gas such as ozone gas. Both of the techniques require a heating device such as a heater and an oxidizing and decomposing gas generation device. For this reason, the device configuration is complex, large and heavy, and the complex, large and heavy device has a problem when vehicles or the like mounts it from the viewpoint of energy saving. Also, the filter has a problem such as clogging or heat-deterioration, and the oxidation catalyst has a problem such as catalyst life or heat-deterioration, too.

Although the related arts individually include a technique of cracking by a heater or the like, a high combustion efficiency cannot be obtained by heating using a heater, and therefore, timing of the combustion is controlled, inflow of a gas is controlled or the combustion is complemented by an ozone generating device or the like.

The present invention is devised to solve the above problems, and an object thereof is to provide a device and a method for combusting particulate matters in which particulate matters discharged from an internal combustion engine can be effectively combusted, and the device configuration is simple and does not become large and heavy.

Problem Resolution Means

The present inventor discovered a device configuration in which an effective combustion is realized and the device configuration is simple and not large and heavy by developing means for lengthening the time when particulate matters receive discharge energy, in order to effectively perform combustion of the particulate matter by silent discharge. Therefore, the present inventor completed the present invention.

Specifically, a combustion device for combusting particulate matters of the present invention for solving the above-described problems comprises:

an introduction portion which connects to an exhaust port of an internal combustion engine, and is used to introduce a particulate matter-containing gas discharged from the exhaust port; a charging unit which is provided on the downstream side of the introduction portion, and in which all or part of the particulate matters are negatively charged by bringing the particulate matter-containing gas into contact with; an electric discharge unit which is provided in an insulation pipe which is connected to the downstream side of the charging unit, and in which the particulate matters, all or part of which are negatively charged, are introduced into a silent discharge area and are combusted with an increased retention time, the silent discharge area being generated between an anode and a cathode; a discharge portion which is connected to the insulation pipe at the downstream side of the electric discharge unit and which discharges the combusted gas; and a power source unit which applies an electric field to the charging unit and the electric discharge unit.

By the present invention, all or part of particulate matters included in a particulate matter-containing gas discharged from an internal combustion engine are negatively charged by a charging unit. Further, the negatively charged particulate matters are introduced into a silent discharge area on the downstream side of the charging unit, and electrically attracted or repelled by constituting electrodes in order to reduce the speed of the negatively charged particulate matters. Therefore, time for the particulate matters to be retained in the silent discharge area can be increased, as well as the combustion efficiency of the particulate matters in the silent discharge area can be improved. As a result, efficient combustion can be realized, and further, miniaturization and weight reduction of the combustion device can be realized by a simple device configuration.

The combustion device for combusting particulate matters of the present invention has following three embodiments having the above technical features.

In the first embodiment of the combustion device for combusting particulate matters, the introduction portion has a gas flow conversion member which changes the flow of the particulate matter-containing gas to a spiral flow, the charging unit has a ring anode provided along the internal circumference of the pipe where the spiral flow flows, and the electric discharge unit has a cylindrical cathode provided on inner wall of the insulation pipe, a cylindrical dielectric provided inside the cathode and a cylindrical mesh anode is spaced from the cylindrical dielectric at predetermined gap on the inside of the cylindrical dielectric.

In the first embodiment of the present invention, the particulate matters in the gas flow changed to the spiral flow by the gas flow conversion member have negative space charge (negative charge) gathered around the ring anode. The particulate matters having the negative space charge are attracted by the electrostatic force of the cylindrical mesh anode and enter the silent discharge area while flowing on the spiral gas flow at the vicinity of the inner wall of the pipe. The speed of the flow of the particulate matters which enter the silent discharge area is reduced by Coulomb force at the silent discharge area extending in the longitudinal direction of the pipe. As a result, the particulate matters obtain much discharge energy and can be efficiently combusted.

In the second embodiment of the combustion device for combusting particulate matters, the charging unit has a planar mesh anode provided orthogonal to a flow channel of the particulate matter-containing gas, the electric discharge unit has: a cylindrical cathode spaced from the inner wall of the insulation pipe at predetermined gap; a cylindrical dielectric provided inside the cathode; a cylindrical mesh anode spaced from the cylindrical dielectric on the inside of the cylindrical dielectric; and a gas flow conversion member which introduces particulate matters charged by the planar mesh anode into the silent discharge area between the cylindrical dielectric and the cylindrical mesh anode.

In the second embodiment of the present invention, the particulate matters in the gas flow have negative space charge gathered around the planar mesh anode. The particulate matters have negative space charge are guided by the gas flow conversion member to the silent discharge area extending in the longitudinal direction of the pipe, and the speed of the flow of the particulate matters is reduced by Coulomb force at the silent discharge area. As a result, the particulate matters obtain much discharge energy and can be efficiently combusted.

In the third embodiment of the combustion device for combusting particulate matters, the charging unit has a planar mesh anode provided orthogonal to a flow channel of the particulate matter-containing gas; and the electric discharge unit has: a planar mesh cathode provided orthogonal to the flow channel; and an anode spaced from the planar mesh cathode at predetermined gap on the upstream side of the planar mesh cathode, and the predetermined gap forms a silent discharge area.

In the third embodiment of the present invention, the particulate matters in the gas flow have negative space charge gathered around the planar mesh anode. The particulate matters have negative space charge are introduced into the silent discharge area through the anode, and the particulate matters are electrically repelled by the planar mesh cathode and the speed of the particulate matters is reduced. As a result, the particulate matters obtain much discharge energy and can be efficiently combusted.

The combustion method for combusting particulate matters of the present invention for solving the above-described problems comprises: negatively charging all or part of particulate matters included in a particulate matter-containing gas discharged from an internal combustion engine; electrically attracting or repelling the negatively charged particulate matters in order to reducing the speed of the negatively charged particulate matters; and increasing retention time for the particulate matters to be retained in a silent discharge area in order to extend time for applying discharge energy at the silent discharge area.

By the present invention, since the particulate matters are combusted in a state that the retention time in the silent discharge area is increased, the combustion efficiency in the silent discharge area can be increased. As a result, an efficient combustion can be realized.

In the first embodiment of the combustion method for combusting particulate matters, the retention time is increased at the silent discharge area by electrostatically attracting the negatively charged particulate matters to a mesh anode which is provided on the downstream side of a flow channel of the particulate matter-containing gas.

In the second embodiment of the combustion method for combusting particulate matters, the retention time is increased at the silent discharge area by electrostatically attracting the negatively charged particulate matters to a mesh anode which is provided on the downstream side of a flow channel of the particulate matter-containing gas.

In the third embodiment of the combustion method for combusting particulate matters, the retention time is increased at the silent discharge area by attracting the negatively charged particulate matters to a mesh anode and depositing the negatively charged particulate matters on the mesh node, the mesh anode being provided on the downstream side of a flow channel of the particulate matter-containing gas.

Efficacy of the Invention

By the combustion devise and the method combustion for combusting particulate matters of the present invention, all or part of particulate matters included in a particulate matter-containing gas discharged from an internal combustion engine are negatively charged by a charging unit. Further, the negatively charged particulate matters are introduced into a silent discharge area on the downstream side of the charging unit, and electrically attracted or repelled by constituting electrodes in order to reduce the speed of the negatively charged particulate matters. Therefore, time for the particulate matters to be retained in the silent discharge area can be increased, as well as the combustion efficiency of the particulate matters in the silent discharge area can be improved. As a result, efficient combustion can be realized, and further, miniaturization and weight reduction of the combustion device can be realized by a simple device configuration.

BRIEF DESCRIPTIONS OF THE DRAWINGS

EMBODIMENT OF THE INVENTION

Next, embodiments of the present invention will be described. The present invention includes the scope including the technical idea thereof, and is not limited to the following description, drawings or the like.

A combustion device and a combustion method for combusting particulate matters of the present invention have means for lengthening the time for receiving discharge energy in order to perform combustion efficiently in silent discharge. The term, "silent discharge" refers to discharge which occurs when one or both of electrode plates with a fixed distance in between is(are) covered with an insulator (dielectric) and an alternating voltage is applied to the electrode plates. Also, the silent discharge is referred to as dielectric barrier discharge. Since the electrode(s) is(are) covered with an insulator(s), an electric charge cannot flow into the electrode(s), and therefore, a large current does not flow. For this reason, in silent discharge, a sound is not heard unlike the case of spark discharge or corona discharge, and thus such discharge is referred to as "silent discharge."

The basic configuration has means for negatively charging all or part of particulate matters included in a particulate matter-containing gas discharged from an internal combustion engine, and means for lengthening time for the particulate matters to be retained in a silent discharge area by reducing the speed of the particulate matters by electrically attracting or repelling the particulate matters in the silent discharge area. By such means, time for applying discharge energy at the silent discharge area can be increased and the particulate matters can be combusted in a state that the retention time in the silent discharge area is increased. As a result, the combustion efficiency in the silent discharge area can be increased, and efficient combustion can be realized.

Figure 1:
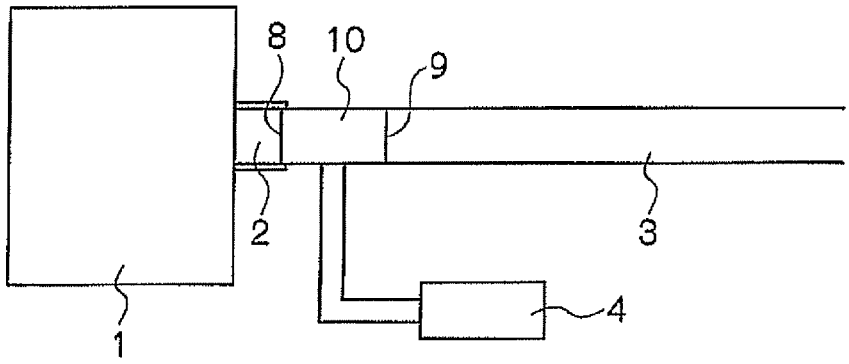
FIG. 1 is a layout drawing of a combustion device for combusting particulate matters of the present invention.
Figure 2:
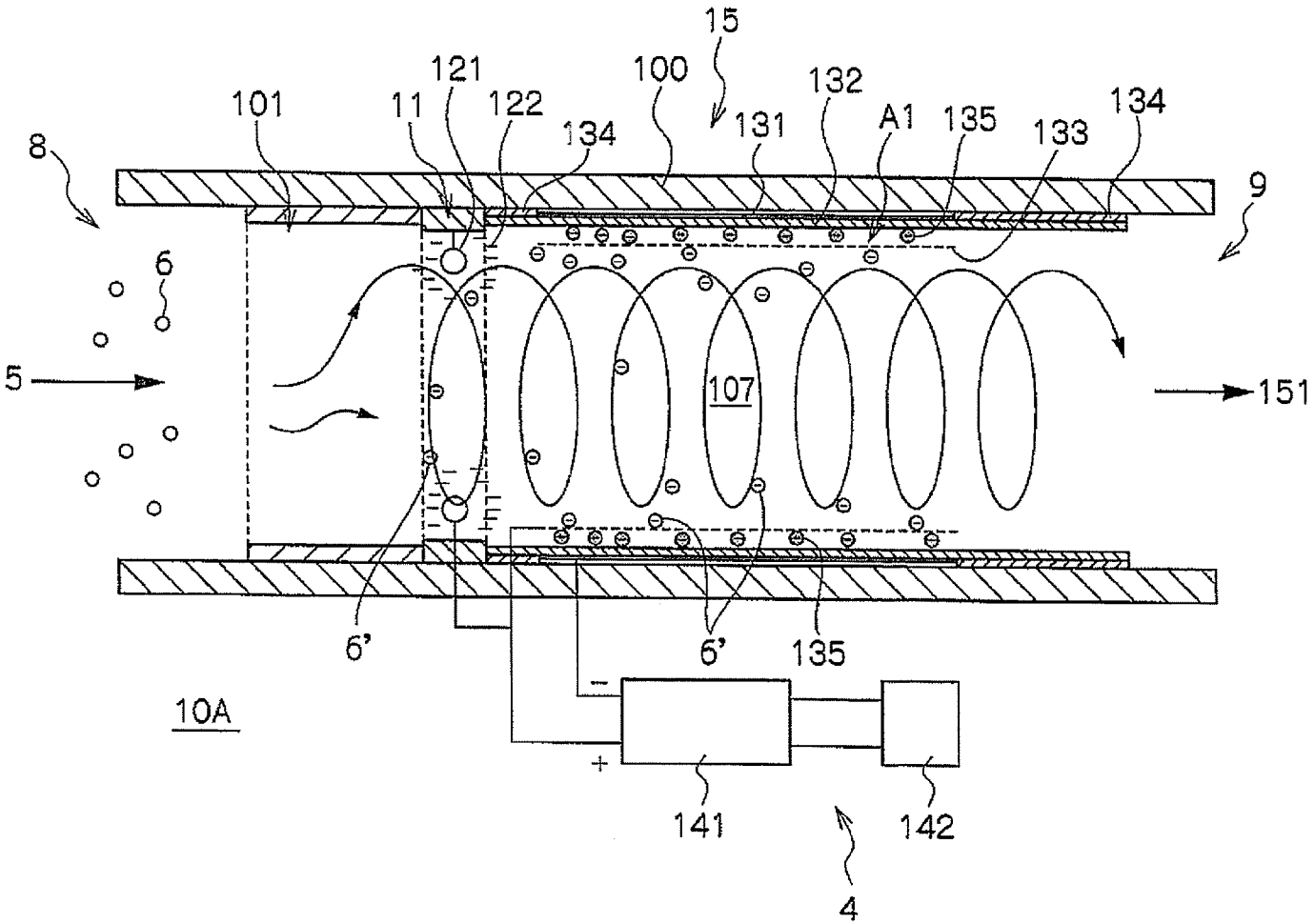
FIG. 2 is a schematic configuration diagram illustrating a first embodiment of a combustion device for combusting particulate matters of the present invention.

As shown in FIG. 1, combustion device 10 for combusting particulate matters of the present invention is provided somewhere on muffler 3 (made of, for example, stainless steel) which is connected to exhaust port 2 of internal combustion engine 1. Generally, combustion device 10 has introduction portion 8 and discharge portion 9 as shown in FIG. 1 and FIG. 2. Introduction portion 8 is connected to exhaust port 2 of internal combustion engine 1; and discharge portion 9 is connected to muffler 3. In order to effectively use the remaining heat from engine 1, combustion device 10 is preferably connected near engine 1 as shown in FIG. 1. The reference sign 4 in FIG. 1 represents a power source unit for applying a voltage to an electric discharge unit performing silent discharge.

Figure 7:
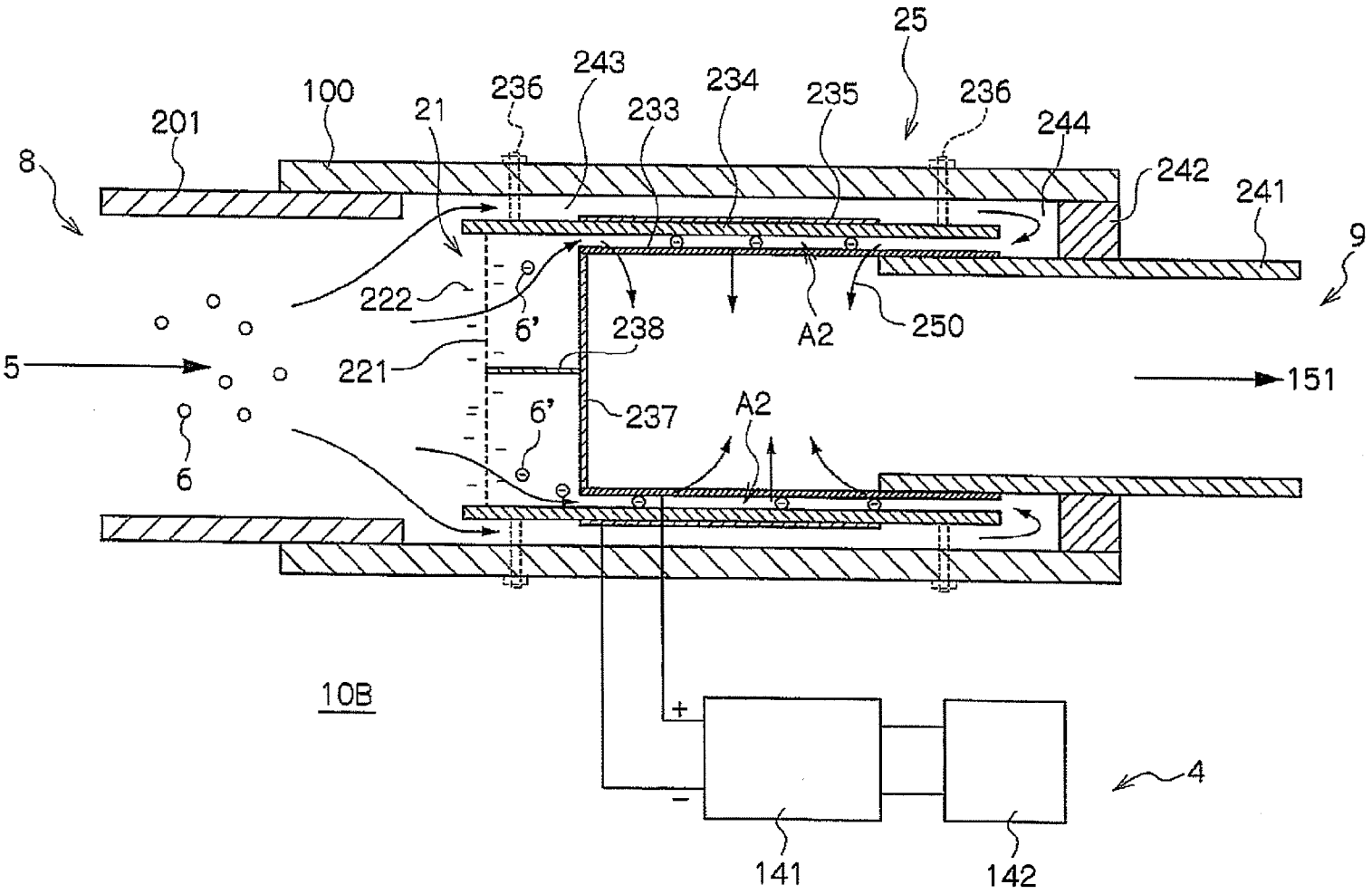
FIG. 7 is a schematic configuration diagram illustrating a second embodiment of a combustion device for combusting particulate matters of the present invention.
Figure 8:
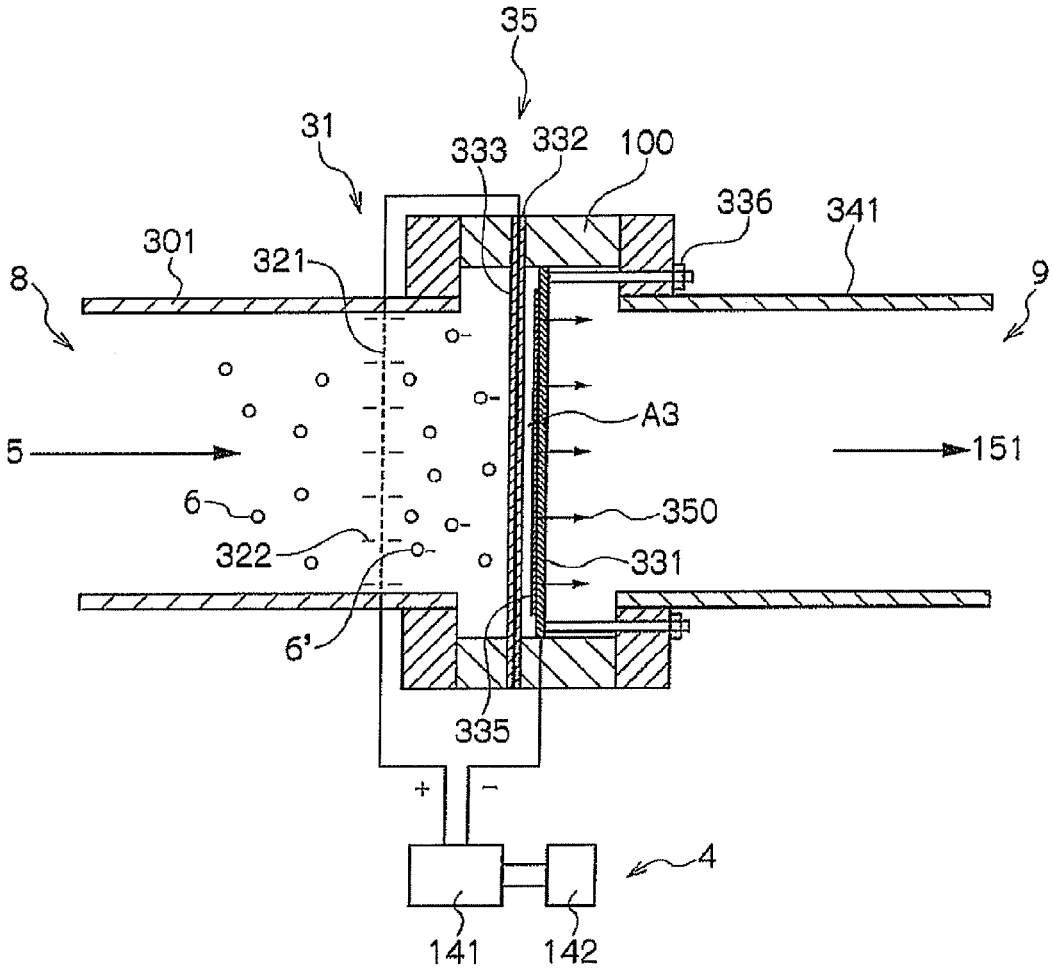
FIG. 8 is a schematic configuration diagram illustrating a third embodiment of a combustion device for combusting particulate matters of the present invention.

As shown in FIG. 2, FIG. 7 and FIG. 8, specifically, combustion device 10 includes: introduction portion 8 which is connected to exhaust port 2 of internal combustion engine 1 and which is used to introduce particulate matter-containing gas 5 discharged from exhaust port 2; charging unit (11, 21, 31) which is provided on the downstream side of introduction portion 8, and in which all or part of particulate matters 6 included in particulate matter-containing gas 5 are negatively charged by bringing particulate matter-containing gas 5 in contact with; electric discharge unit (15, 25, 35) which is provided in insulation pipe 100 connected to the downstream side of charging unit (11, 21, 31), and in which particulate matters 6', all or part of which are negatively charged, are introduced into a silent discharge area (A1, A2, A3) which is generated between an anode and a cathode, and are combusted with an increased retention time; discharge portion 9 which is connected to insulation pipe 100 at the downstream side of electric discharge unit (15, 25, 35) and which discharges combusted gas 7; and power source unit 4 which applies an electric field to charging unit (11, 21, 31) and electric discharge unit (15, 25, 35).

There are three embodiments, the first to the third embodiments, of the present invention in which negatively charged particulate matters 6' are electrically attracted or repelled to reduce the speed of negatively charged particulate matters 6'.

As shown in FIG. 2, the first embodiment of a combustion device and a combustion method for combusting particulate matters is configured so as to electrostatically attract negatively charged particulate matter 6' to cylindrical mesh anode 133, which is provided on the downstream side of a flow channel of the particulate matter-containing gas 5, and to retain negatively charged particulate matter 6' at silent discharge area A1, in order to increase the retention time when negatively charged particulate matter 6' is retained at silent discharge area A1.

As shown in FIG. 7, the second embodiment of a combustion device and a combustion method for combusting particulate matters is configured so as to attract negatively charged particulate matter 6' to cylindrical mesh anode 233, which is provided on the downstream side of the flow channel, and can capture particulate matter 6', and to deposit particulate matter 6' on anode 233 in order to increase the retention time when negatively charged particulate matter 6' is retained at silent discharge area A2.

As shown in FIG. 8, the third embodiment of a combustion device and a combustion method for combusting particulate matters is configured so as to electrostatically repel negatively charged particulate matter 6' by planar mesh cathode 331, which is provided on the downstream side of the flow channel, and to deposit negatively charged particulate matter 6' on cathode 331, in order to increase the retention time when negatively charged particulate matter 6' is retained at silent discharge area A3.

By such a combustion device and a combustion method for combusting particulate matters of the present invention, all or part of particulate matters 6 included in particulate matter-containing gas 5 discharged from internal combustion engine 1 are negatively charged by charging unit (11, 21, 31); negatively charged particulate matters 6' are introduced into silent discharge area (A1, A2, A3) and electrically attracted or repelled by constituting electrodes (13, 23, 33 or 14, 24, 34), in order to reduce the speed of negatively charged particulate matters 6'. As a result, and retain time for particulate matters 6' to be retained in silent discharge area (A1, A2, A3) is increased, and the particulate matters can be combusted in such a state. By such an invention, the combustion efficiency in silent discharge area (A1, A2, A3) can be improved and efficient combustion can be realized, and further, miniaturization and weight reduction of the device can be realized by a simple device configuration.

EMBODIMENT

Representative three embodiments of a combustion device for combusting particulate matters of the present invention will be described in detail with reference to the drawings.

First Embodiment

As shown in FIG. 2, the first embodiment of combustion device 10A for combusting particulate matters is configured so as to electrostatically attract particulate matter 6' on which negative charge 122 is charged to cylindrical mesh anode 133, which is provided on the downstream side, and to retain particulate matter 6' at silent discharge area A1, in order to increase the retention time at silent discharge area A1. Specifically, as shown in FIG. 2, the device 10A includes introduction portion 8, charging unit 11, electric discharge unit 15, discharge portion 9 and power source unit 4.

As shown in FIG. 2, combustion device 10A is preferably configured to have introduction portion 8, charging unit 11, electric discharge unit 15 and discharge portion 9 in the order mentioned toward the downstream side in insulation pipe 100. Each of the portions may be connected to each other as a separate member in the order mentioned toward the downstream side. Further, combustion device 10A is preferably configured to have, as a substrate, ceramic insulation pipe 100 having heat insulating properties and electrical insulating properties. The term "upstream side" herein refers to the internal combustion engine side or the introduction portion side, and the term "downstream side" herein refers to the muffler side or the discharge portion side. Each component will now be described.

(Introduction Portion)

As shown in FIG. 1 and FIG. 2, introduction portion 8 is connected to exhaust port 2 of internal combustion engine 1, and is used to introduce particulate matter-containing gas 5 discharged from exhaust port 2. Introduction portion 8 is preferably integrated with insulation pipe 100 (for example, ceramic insulation pipe) including electric discharge unit 15 and charging unit 11. Introduction portion 8 may be formed by an introduction pipe which is a separate member, and connected to insulation pipe 100. Particulate matter-containing gas 5 to be introduced includes particulate matter 6 which is a target.

Figure 3:
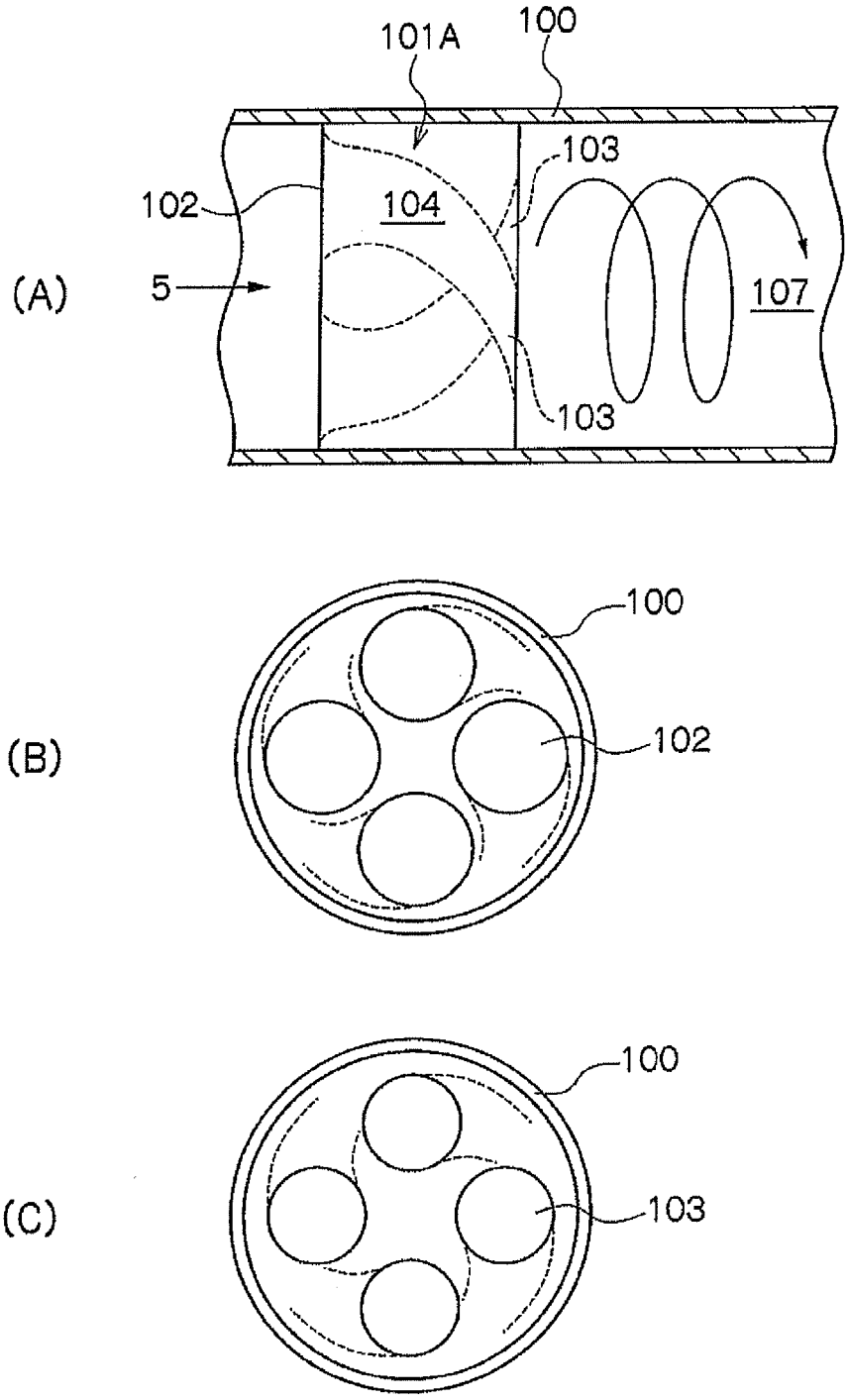
FIGS. 3A, 3B and 3C are schematic configuration diagrams illustrating one example of a gas flow conversion member.
Figure 4:
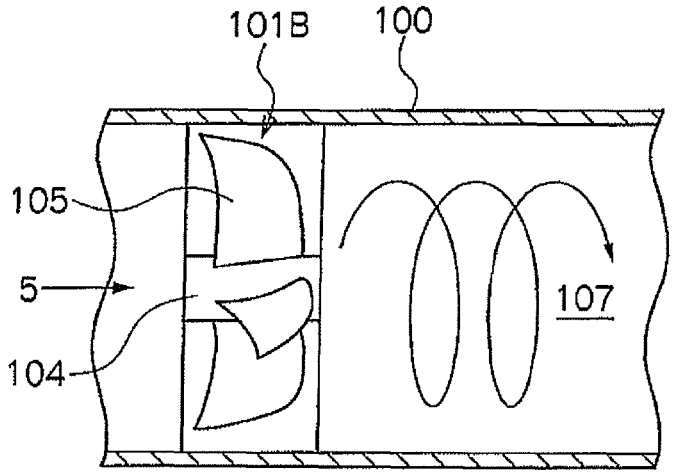
FIG. 4 is a schematic configuration diagram illustrating another example of a gas flow conversion member.

As illustrated in FIG. 3 and FIG. 4, introduction portion 8 has gas flow conversion member 101 which changes the flow of particulate matter-containing gas 5 into spiral flow 107.

FIGS. 3A, 3B and 3C are schematic configuration diagrams illustrating one example of a gas flow conversion member. FIG. 3A is a schematic diagram, FIG. 3B is a view from the upstream side and FIG. 3C is a view from the downstream side. Gas flow conversion member 101A as shown in FIG. 3 generates spiral flow 107 by allowing a gas flow to pass through a plurality of twisted flow channels 104, and includes a plurality of inflow ports 102 and as many outflow ports 103. Particulate matter-containing gas 5 which is input from inflow port 102 is converted into spiral flow 107 when the particulate matter-containing gas passes through flow channel 104 and is output from outflow port 103. The numbers of inflow ports 102 and outflow ports 103 are not limited, and the numbers are two or more, and preferably three or four individually. Each of flow channel 104 is twisted clockwise or counterclockwise toward outflow port 103, and further, each of flow channel 104 is provided with a prescribed angle θ (for example, from 15° to 45°) such that each of opening of outflow port 103 faces to the inner wall of insulation pipe 100.

In the example of FIG. 3, particulate matter-containing gas 5 is divided into four gas flows at four inflow ports 102 and the each of divided gas flows pass through flow channel 104 and flow out as spiral flow 107 from outflow port 103, respectively. Each of inflow ports 102 and each of outflow ports 103 are placed at regular intervals individually. This member material preferably has heat resistance and corrosion resistance. Gas flow conversion member 101A is not limited to the example as shown in FIG. 3 as long as the member has such a principle.

FIG. 4 is a schematic configuration diagram illustrating another example of a gas flow conversion member. Gas flow conversion member 101B as shown in FIG. 4 generates spiral flow 107 by rotation of blade 106 attached to propeller shaft 105. Propeller shaft 105 may freely rotate, or be driven to rotate. Generally, a device which is driven to rotate is used. Particulate matter-containing gas 5 is converted into spiral flow 107 by rotation of propeller shaft 105 and blade 106. The number of blades 106 is not limited, and generally three or four. This member material also preferably has heat resistance and corrosion resistance.

(Charging Unit)

Figure 5:
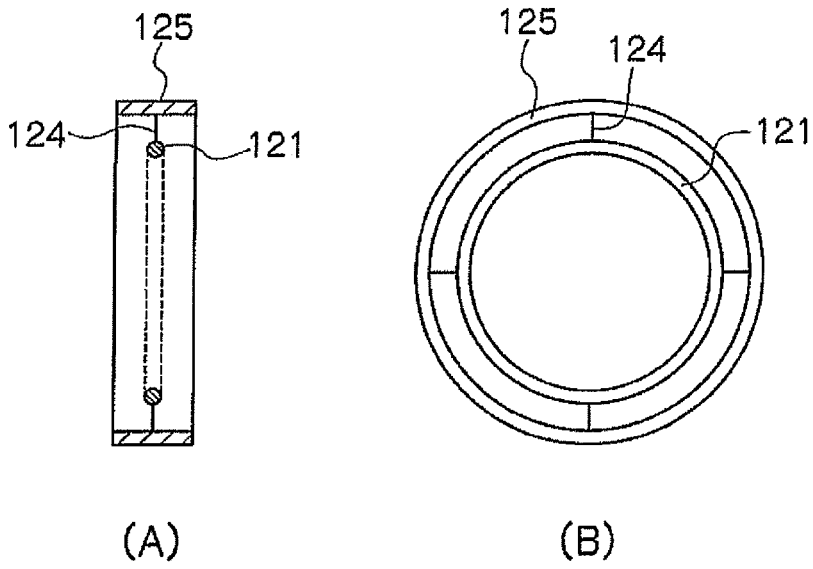
FIGS. 5A and 5B are configuration diagrams illustrating one example of a ring anode.

Charging unit 11 is a unit which is provided on the downstream side of introduction portion 8, and in which negative space charge 122 (also simply referred to as "negative charge") is charged on all or part of particulate matter 6 included in particulate matter-containing gas 5 by bringing particulate matter-containing gas 5 into contact with. In the first embodiment, as shown in FIG. 2 and FIG. 5, ring anode 121 provided along the internal circumference of the pipe where spiral flow 107 flows is preferably used. Specifically, ring anode 121 is spaced at predetermined gap from the internal circumference surface orthogonal to the longitudinal direction of the pipe. Ring anode 121 shown in FIG. 5 is an example that thin ring metal electrode is held in ring member 125 by four supporting members 124. Positive high voltage is applied to the thin ring metal electrode from power source unit 4. The thin ring metal electrode as ring anode 121 is generally formed by stainless steel or the like, and has a conductor diameter of about 1 mm, but not limited thereto.

Since negative charge 122 gathers around ring anode 121, particulate matter-containing gas 5 which flows along the inner wall of the pipe as spiral flow 107 is in contact with anode 121. As a result, particulate matter 6 included in particulate matter-containing gas 5 has negative charge 122, and negatively charged particulate matter 6' flows in the pipe as spiral flow 107. Since spiral flow 107 provide particulate matter 6' with a centrifugal force, a force in the inner wall direction of the pipe is applied to particulate matter 6', and therefore, spiral flow 107 proceeds along the inner wall of the pipe.

(Discharge Device)

Figure 6:
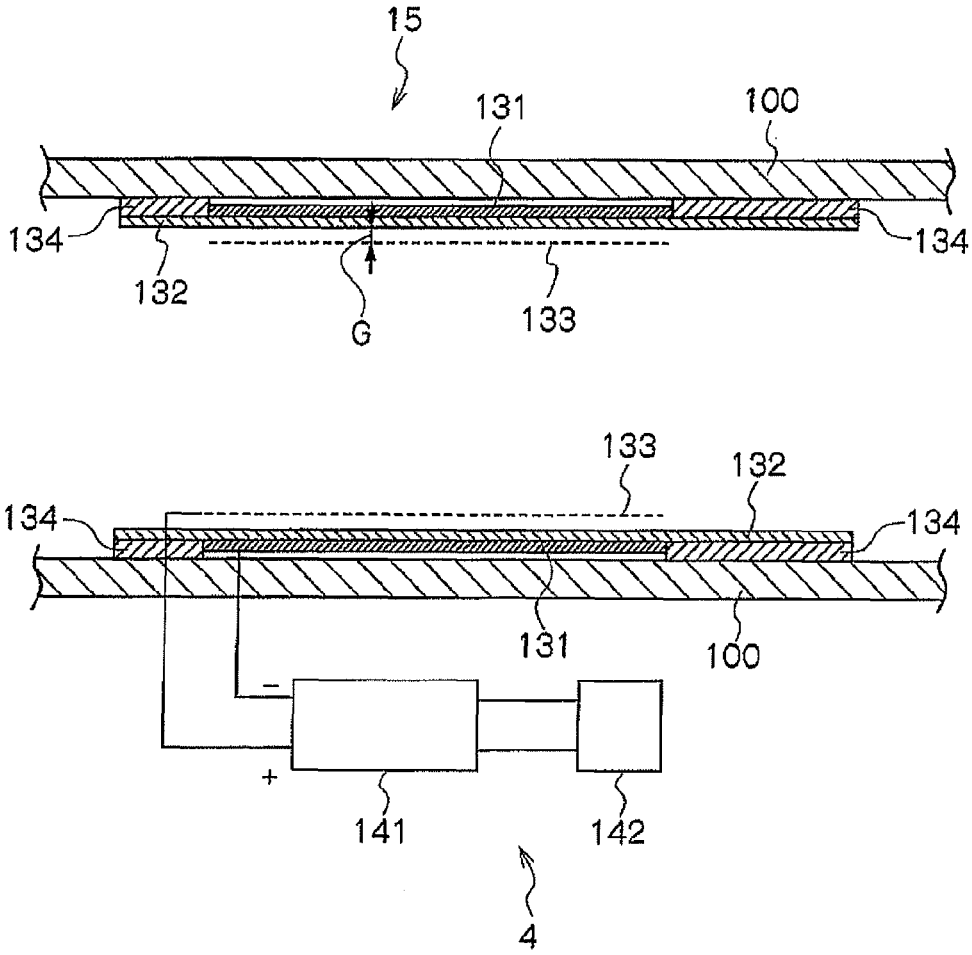
FIGS. 6A and 6B are a schematic configuration diagram illustrating one example of an electric discharge unit.

As shown in FIG. 2 and FIG. 6, electric discharge unit 15 is a unit which is provided in insulation pipe 100 which is connected to the downstream side of charging unit 11, and in which particulate matters 6', on all or part of which negative charge 122 is charged, are introduced into silent discharge area A1 which is generated between anode 133 and cathode 131, and are combusted with an increased retention time. Specifically, as shown in FIG. 6, electric discharge unit 15 has: cylindrical cathode 131 provided on the inner wall of insulation pipe 100; cylindrical dielectric 132 provided inside cathode 131; and cylindrical mesh anode 133 spaced from inside of dielectric 132 at predetermined gap G.

Electric discharge unit 15 is preferably provided in ceramic insulation pipe 100 having heat resistance, heat insulating properties and electrical insulating properties. Not only in electric discharge unit 15, but also in the above-mentioned charging unit 11, it is preferable that electric discharge unit 15 and charging unit 11 be provided in integrated insulation pipe 100 as shown in FIG. 2. The inner diameter of insulation pipe 100 is not limited, and generally, in the range of about 20 to 100 mm.

On the inner surface of insulation pipe 100, cylindrical cathode 131 is provided, and cathode 131 may be a stainless metal body having a thickness of, for example, about 0.1 mm. Insulation pipes 134, 134 are provided on the both ends (the upstream end and the downstream end) of cylindrical cathode 131 in the longitudinal direction. Cathode 131 may be in close contact with insulation pipe 100, and spaced from insulation pipe 100 at a little gap as shown in FIG. 6.

Cylindrical dielectric 132 is provided inside (on the center side of the pipe, same as below) the above-mentioned cylindrical cathode 131. Preferably, dielectric 132 is ceramic dielectric having, for example, a thickness of 1 mm, and specifically, formed by alumina or the like. Generally, the dielectric 132 is provided in close contact with cathode 131.

Preferably, cylindrical mesh anode 133 is formed on the inside of cylindrical dielectric 132, and spaced from dielectric 132 at gap G, which is about 1 mm, for example. Anode 133 has mesh structure which has openings allowing particulate matter 6' to pass through. The size of the opening is such that, for example, particulate matter 6 of 2 μm can freely pass through the opening, but not limited. The material of anode 133 is not limited, but tungsten mesh having high heat resistance is preferably used. For example, a tungsten mesh having a wire diameter of 0.4 mm and 20 mesh/inch can be exemplified.

A high voltage with a high frequency is applied between cathode 131 and anode 133 from power source unit 4 in order to generate silent discharge. Since particulate matter 6' flows on spiral flow 107 near the inner wall of the pipe, duration time of discharging in silent discharge area A1 becomes longer than the duration time when the particulate matter 6' flows straightly in the pipe. Further, since particulate matter 6' which flows on the inner wall side of the pipe passes through the mesh opening of anode 133 by the centrifugal force based on spiral flow 107, it is easy that particulate matter 6' flows in silent discharge area A1, and receives silent discharge. Further, since particulate matter 6' is negatively charging and then, attracted to anode 133 by Coulomb force, and particulate matter 6' tends to retain in silent discharge area A1 for a long time. As a result of this retention of particulate matter 6' in silent discharge area A1, particulate matter 6' receives the discharge energy of the silent discharge for a long time, more efficient combustion is performed due to Joule heat by a large discharge energy or the residual heat of combustion of particulate matter 6'.

Toxic components (NOx, SOx) included in particulate matter-containing gas 5 can be reformed and removed by a high electric field in silent discharge area A1.

(Power Source Unit)

Power source unit 4 is a unit which applies an electric field to charging unit 11 and electric discharge unit 15. As shown in FIG. 2 and FIG. 6, power source unit 4 has high voltage and high frequency generator 141 and power source 142. Power source 142 may be a direct-current power source or alternating-current power source, and may be a cell (battery). From such power source 142, a direct voltage or an alternating voltage is transmitted to high voltage and high frequency generator 141. In high voltage and high frequency generator 141, the voltage is converted into a high voltage with high frequency or high pulse voltage.

The positive voltage terminal of high voltage and high frequency generator 141 is connected to ring anode 121 of charging unit 11 and cylindrical mesh anode 133 of electric discharge unit 15. On the other hand, the negative voltage terminal is connected to cylindrical cathode 131. Silent discharge is generated between cylindrical mesh anode 133 to which the positive voltage terminal is connected and cylindrical cathode 131 to which the negative voltage terminal is connected. Ring anode 12 to which a positive voltage terminal is connected attracts negative space charge 122.

(Discharge Portion)

Discharge portion 9 is connected to insulation pipe 100 on the downstream side of electric discharge unit 15, and discharges combusted gas 151. Herein, the term "connected to insulation pipe 100" means that an discharge portion is formed by a discharge pipe which is a separate member, and the discharge portion is connected to insulation pipe 100 (see FIG. 7 and FIG. 8), or one integrated with insulation pipe 100 which the end of the downstream side is used as a discharge portion (see FIG. 2). The combustion treated gas becomes exhaust gas 151, and, as shown in FIG. 1, discharged from muffler 3 connected to the downstream side of combustion device 10.

As described above, in the first embodiment of combustion device 10A, particulate matter 6 in the gas flow converted to spiral flow 107 by gas flow conversion member 101 has negative space charge 122 gathered around ring anode 121. While particulate matter 6' having negative space charge 122 flows on spiral flow 107 near the inner wall of a pipe, particulate matter 6' is attracted also by cylindrical mesh anode 133 and flows in silent discharge area A1. The speed of the flow of particulate matter 6' which flows in silent discharge area A1 is reduced by Coulomb force at silent discharge area A1 extending in the longitudinal direction of the pipe. As a result, the particulate matters obtain much discharge energy and can be efficiently combusted.

By such combustion device 10A, the combustion of particulate matter is performed under a more power saving condition, by being connected near exhaust port 2 of engine 1, preventing heat loss by covering the combustion portion by insulation pipe 100, increasing the retention time at silent discharge area A1 by Coulomb force by providing particulate matter 6 with negative charge 122, and using a high frequency or high pulse discharge. Further, other toxic components (NOx, SOx) included in particulate matter-containing gas 5 can be decomposed and removed. Since combustion device 10 of the present invention which can realize such an effective combusting is simple and small and has light weight, combustion device 10 is suitable for vehicle or the like.

Second Embodiment

As shown in FIG. 7, the second embodiment of combustion device 10B for combusting particulate matters is configured so electrostatically attract particulate matter 6', which has negative charge 222, to cylindrical mesh anode 233 which is provided on the downstream side of the flow channel, and can capture particulate matter 6' and to deposited particulate matter 6' on cylindrical mesh anode 233, in order to increase the retention time at silent discharge area A2. Specifically, as shown in FIG. 7, the combustion device 10B includes introduction portion 8, charging unit 21, electric discharge unit 25, discharge portion 9 and power source unit 4 in the order mentioned toward the downstream side. Although, in the example in FIG. 7, charging unit 21 and electric discharge unit 25 are configured as one in insulation pipe 100, charging unit 21 and electric discharge unit 25 may not be necessarily configured as one.

In the same manner as in the first embodiment, introduction portion 8 is connected to exhaust port 2 of internal combustion engine 1, and particulate matter-containing gas 5 discharged from exhaust port 2 is introduced into introduction portion 8. In the example in FIG. 7, introduction portion 8 is formed by pipe 201 which has a smaller diameter than that of insulation pipe 100. Introduction portion 8 is connected such that pipe 201 is inserted into the upstream end of insulation pipe 100. On the other hand, in the same manner as in the first embodiment, discharge portion 9 is also connected to insulation pipe 100 and discharges combusted gas 151. In the example in FIG. 7, discharge portion 9 is formed by pipe 241 having a diameter smaller than those of insulation pipe 100 and pipe 201. Discharge portion 9 is connected such that pipe 241 is inserted into the downstream end of insulation pipe 100 via coaxial ring 242. Coaxial ring 242 is an important member which secures the below-described silent discharge area A2 and inner wall flow channel 243, and has a width in the radial direction by which these flow channels can be secured.

The term "upstream side" herein refers to the side of internal combustion engine 1 as shown in FIG. 1, and the term "downstream side" herein refers to the side of muffler 3 as shown in FIG. 1. In the illustrated example, since pipe 241 which constitutes discharge portion 9 is provided so as to function as a supporting member of cylindrical mesh anode 233, pipe 241 preferably has insulation properties. On the other hand, since pipe 201 which constitutes introduction portion 8 is not in contact with an electrode, it may be a metal pipe made of stainless steel or the like, and may be an insulation pipe.

The configurations of introduction portion 8 and discharge portion 9 are not limited to the examples of connecting pipes illustrated in the figures. Namely, it is only necessary for pipe 201 which constitutes introduction portion 8 to be connected to insulation pipe 100 which constitutes charging unit 21 and electric discharge unit 25. Also, it is only necessary for pipe 241 which constitutes introduction portion 9 to be connected to insulation pipe 100 which constitutes charging unit 21 and electric discharge unit 25. Although, in the illustrated example, silent discharge area A2 and inner wall flow channel 243 is secured by configuring pipe 241 to have a smaller diameter, it is unnecessary to use pipe 241 having a smaller diameter. Silent discharge area A2 and inner wall flow channel 243 are formed by using another member.

In introduction portion 8, a gas flow conversion member which converts particulate matter-containing gas 5 into spiral flow 107 as shown in FIG. 3 and FIG. 4 is not provided. However, plate-like flow channel control member 237 is provided as a gas flow conversion member which controls the flow channel of particulate matter-containing gas 5 which is introduced. Plate-like flow channel control member 237 is used as a member which interrupts the flow of particulate matter-containing gas 5, which is introduced into introduction portion 8 and proceeds in the longitudinal direction of insulation pipe 100, and flows particulate matter-containing gas 5 into silent discharge area A2 from the periphery of plate-like flow channel control member 237. The shape of this plate-like flow channel control member 237 is preferably a disk shape when the cross-sectional shape of electric discharge unit 25 is circle, and preferably a regular tetragon when the cross-sectional shape of electric discharge unit 25 is tetragon.

Plate-like flow channel control member 237 is supported by pillar 238 extending from the center portion of the below-mentioned planar mesh anode 221. On the other hand, the periphery of plate-like flow channel control member 237 supports the upstream side of cylindrical mesh anode 233. The downstream side of cylindrical mesh anode 233 is supported by insulation pipe 241 which constitutes discharge portion 9. Insulation pipe 241 is fixed to insulation pipe 100 via coaxial ring 242 which is inserted into the periphery thereof.

The material of plate-like flow channel control member 237 is not limited. When cylindrical mesh anode 233 and planar mesh anode 221 placed on the upstream side are electrically connected as shown in FIG. 7, cylindrical mesh anode 233 and planar mesh anode 221 may be, for example, formed by metal such as stainless steel. In this case, pillar 238 is also formed by an electrically conducting material. On the other hand, plate-like flow channel control member 237 may be formed by a metal mesh or an electrically insulating mesh, when a positive voltage is applied to planar mesh anode 221 by another wiring, or when pillar 238 is used simply as a supporting member to support from the upstream side of plate-like flow channel control member 237 without making planar mesh anode 221 function as an electrode. In this case, pillar 238 is composed of an insulating material.

On the upstream side of plate-like flow channel control member 237 and on the downstream side of introduction portion 8, planar mesh anode 221 as charging unit 21 is provided orthogonal to the flow channel of particulate matter-containing gas 5. Planar mesh anode 221 is supported by cylindrical dielectric 234 so that the periphery of cylindrical dielectric 234 is inserted in the upstream end of cylindrical dielectric 234. On the center portion of planar mesh anode 221, pillar 238 for supporting the above-mentioned plate-like flow channel control member 237 which is placed on the downstream side of planar mesh anode 221 is provided.

In the same manner as in the first embodiment, planar mesh anode 221 is a member used to bring particulate matter-containing gas 5 into contact with, and to negatively-charge all or part of particulate matter 6 included in particulate matter-containing gas 5 by negative charge 22. For this reason, a positive voltage is preferably applied to planar mesh anode 221 from power source unit 4. Since negative space charge (negative charge) 222 gathers to planar mesh anode 221 on which a positive voltage is applied, particulate matter 6 included in particulate matter-containing gas 5 which passes through planar mesh anode 221 has negative charge 222. Namely, particulate matter 6 is negatively-charged by passing through planar mesh anode 221, and flows to the downstream side. The flow of particulate matter 6' which flowed to the downstream side is controlled by plate-like flow channel control member 237 and flows into silent discharge area A2 by electrically attracting to cylindrical mesh anode 233.

Planar mesh anode 221 may have a mesh structure which has, for example, an opening through which particulate matter 6 of 2 μm can freely pass. The material of planar mesh anode 221 is not limited, and preferably a heat resistant metal mesh. For example, a tungsten mesh or a tungsten alloy mesh is preferably used, but not limited thereto. For example, a tungsten mesh having a wire diameter of 0.4 mm and 20 mesh/inch can be used.

As shown in FIG. 7, electric discharge unit 25 in the second embodiment is a unit which is provided in insulation pipe 100 which is connected to the downstream side of charging unit 11. Further, electric discharge unit 25 is used to introduce all or part of the particulate matter 6' which has negative charge 222, into silent discharge area A2 which is generated between anode 233 and cathode 235, in order to increase an increased retention time and combust the particulate matter 6'. Specifically, electric discharge unit 25 has: cylindrical cathode 235 spaced from the inner wall of insulation pipe 100 at a predetermined gap which is flow channel 243; cylindrical dielectric 234 provided inside cathode 235; cylindrical mesh anode 233 spaced from the inside of dielectric 234 at predetermined gap (not limited, and for example, in a range of about 0.5 mm to 3 mm).

Cylindrical cathode 235 is spaced from the inner wall side of insulation pipe 100 at a predetermined gap (not limited, but, for example, in a range of 1 mm to 10 mm), and may be formed, for example, by a metal body of stainless steel having a thickness of about 0.5 mm. In the example of FIG. 7, cathode 235 is provided in close contact with the external surface of the below-described cylindrical dielectric 234. Flow channel (inner wall flow channel) 243 is formed between cathode 235 and insulation pipe 100.

Cylindrical dielectric 234 is provided inside the above-mentioned cylindrical cathode 235. Dielectric 234 is fixed on insulation pipe 100 by a plurality of supporting bolts 236. Dielectric 234 is a ceramic dielectric having a thickness of about 1 mm. Specifically, dielectric is preferably formed by a material such as alumina. Dielectric 234 fixed in the insulation pipe by supporting bolts 236 has a space which is able to form inner wall flow channel 243 between dielectric 234 and insulation pipe 100.

Cylindrical mesh anode 233 is preferably formed by a heat resistant metal fiber mesh (for example, wire diameter (20 μm), porosity: 80%, thickness: 1.3 mm) For example, stainless metal fiber mesh is preferably used, but not limited thereto. The openings of the mesh may have such a size that, for example, particulate matter 6' of 0.1 μm does not easily pass the mesh and the mesh can capture.

Since this cylindrical mesh anode 233 can capture particulate matter 6', particulate matter 6' is provided with sufficient discharge energy while particulate matter 6' introduced into silent discharge area A2 by circular plate-like flow channel control member 237 is captured by the mesh structure. As a result, efficient combustion can be realized. After the combustion, particulate matter 6' becomes combustion gas 250 and passes through the mesh and is discharged from discharge portion 9 as exhaust gas 151.

As shown in FIG. 7, flow channel 243 having the above-mentioned prescribed gap (not particularly limited, but, for example, in a range of 1 mm to 10 mm) is formed between cylindrical dielectric 234 provided with cylindrical cathode 235 on the insulation pipe 100 side and insulation pipe 100. The gas flow which flows in inner wall flow channel 243 is different from the gas flow introduced into silent discharge area A2 by plate-like flow channel control member 237. However, particulate matter-containing gas 5 which has flowed in inner wall flow channel 243 turns around (goes back) at the downstream end portion of the pipe structure (turn-around portion) 244 to flow into silent discharge area A2.

Since particulate matter 6 in particulate matter-containing gas 5 which has flowed into silent discharge area A2 cannot pass through the metal fiber mesh structure of cylindrical mesh anode 233 and is captured by the structure, particulate matter 6 receives discharge energy and is combusted while being captured.

Because the second embodiment of combustion device 10B has a double pipe structure having two routes of flow channels, combustion device 10B has a flow channel which introduces particulate matters from both the upstream side and the downstream side of cylindrical metal fiber mesh anode 233. Therefore, the particulate matters can be deposited with economy on metal fiber mesh 233 along the longitudinal direction of cylindrical mesh anode 233, and provided with discharge energy and combusted.

Since power source unit 4 is the same as in the first embodiment, the description thereof is omitted.

As described above, in the second embodiment of combustion device for combusting particulate matters 10B, particulate matter 6 in the gas flow has negative space charge 222 gathered around planar mesh anode 221. Particulate matter 6' having negative space charge 222 is introduced into silent discharge area A2 extending in the longitudinal direction of pipe 100 by plate-like flow channel control member 237, attracted by Coulomb force of silent discharge area A2 and captured by cylindrical mesh anode 233 which constitutes silent discharge area A2, whereby the retention time at silent discharge area A2 is increased. As a result, the particulate matter obtains much discharge energy and can be efficiently combusted.

Third Embodiment

As shown in FIG. 8, the third embodiment of combustion device 10C for combusting particulate matters is configured so that the deposition of particulate matters 6', which are included in particulate matters and have negative charge, on cathode 331 is increased, and then, combustion effect is improved, based on the repelling effect that particulate matters 6' having negative charge are electrostatically repelled by planar metal fiber mesh cathode 331 provided on the downstream side, and the trapping effect of planar metal fiber mesh which constitutes cathode 331. Specifically, as shown in FIG. 8, combustion device 10C has: introduction portion 8, charging unit 31, electric discharge unit 35, discharge portion 9 and power source unit 4 in the order mentioned toward the downstream side. In the example in FIG. 8, charging unit 31 is provided on introduction portion 8 and electric discharge unit 35 is provided in electrically insulating quadrangular prism pipe 100.

In the same manner as in the first embodiment, introduction portion 8 is connected to exhaust port 2 of internal combustion engine 1, and particulate matter-containing gas 5 discharged from exhaust port 2 is introduced into introduction portion 8. Introduction portion 8 is formed by pipe 301 which has a smaller diameter than that of insulation pipe 100, and is connected to the upstream side of insulation pipe 100. On the other hand, in the same manner as in the first embodiment, discharge portion 9 is also connected to insulation pipe 100 and discharges combusted gas 151. Discharge portion 9 is formed by pipe 341 having a diameter smaller than that of insulation pipe 100, and is connected to the downstream side of electrically insulating quadrangular prism pipe 100. The connection configurations of pipes 301, 341 to electrically insulating quadrangular prism pipe 100 are not limited.

The term "upstream side" herein refers to the side of engine 1 as shown in FIG. 1, and the term "downstream side" herein refers to the side of muffler 3 as shown in FIG. 1. Like ceramic pipe, both pipes 301, 341 preferably have electrical insulating properties and heat resistance. Introduction portion 8 is not provided with a gas flow conversion member shown in FIG. 3, FIG. 4 and FIG. 7.

On the downstream side of introduction portion 8, planar mesh anode 321 as charging unit 31 is provided orthogonal to the flow channel of particulate matter-containing gas 5. Planar mesh anode 321 is attached to the inner surface of pipe 301 by an attachment which is not illustrated in the figure.

In the same manner as in the first and the second embodiment, planar mesh anode 321 is a member which negatively-charge all or part of particulate matter 6 included in particulate matter-containing gas 5 by bringing particulate matter-containing gas 5 into contact with. For this reason, a positive voltage is preferably applied to planar mesh anode 321 from power source unit 4. Since negative space charge (negative charge) 322 gathers to planar mesh anode 321 on which a positive voltage is applied, part of particulate matter 6 included in particulate matter-containing gas 5 which passes through planar mesh anode 221 has negative charge 322. Namely, particulate matter 6 is negatively-charged by passing through planar mesh anode 221, and flows to the downstream side.

Planar mesh anode 321 may have a mesh structure which has, for example, openings through which particulate matter 6 of 2 μm can freely pass. The material of planar mesh anode 321 is not limited, and preferably a heat resistant metal mesh. For example, a tungsten mesh or a stainless mesh having a wire diameter of 0.4 mm and 20 mesh/inch can be exemplified, but not limited thereto. The distance between this anode 321 and cathode 331 provided on the downstream side of anode 321 is not limited, and usually, may be in a range of 10 mm to 100 mm.

As shown in FIG. 8, electric discharge unit 35 in the third embodiment is provided in electrically insulating quadrangular prism pipe (square prism pipe) 100 which is connected to introduction portion 8. Electric discharge unit 35 has: planar metal fiber mesh cathode 331 provided orthogonal to a flow channel in electrically insulating quadrangular prism pipe 100; and dielectric covered anode 330 provided so that silent discharge area A3 is spaced from planar metal fiber mesh cathode 331 at predetermined gap not particularly limited, but, for example, 0.5 mm to 3 mm), and faces to planar metal fiber mesh cathode 331. Instead of dielectric covered anode 330, a metal mesh which is covered with dielectric may be used. By this electric discharge unit 35, particulate matters 6', on all or part of which has negative charge 322, are introduced into silent discharge area A3 which is generated between the device and dielectric covered anode 330, and the deposited particulate can be combusted.

Figure 9:
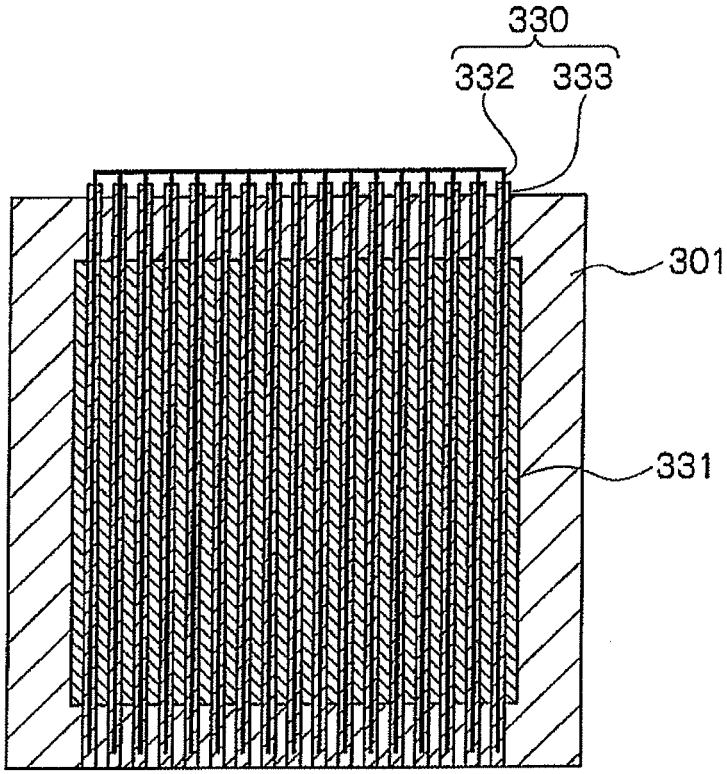
FIG. 9 is a schematic configuration diagram illustrating one example of an electric discharge unit viewed from an introduction portion side.

As shown in FIG. 8 and FIG. 9, dielectric covered anode 330 is a complex formed by rod anode 332 and dielectric 333 which covers rod anode 332. In the illustrated example, rod dielectric covered anodes 330 are arrayed in a reed shape at regular intervals (for example, at a pitch of 2 to 6 mm and a gap of 0.5 mm to 3 mm) so that each of rod dielectric covered anodes 330 spaced from planar metal fiber mesh cathode 331 at predetermined fixed distance. All dielectric covered anodes 330 are electrically connected. Particulate matter 6' on gas flow easily passes through reed-shaped dielectric covered anodes 330. Instead of a dielectric covered anode, a dielectric covered mesh anode may be used.

Rod anode 332 which constitutes dielectric covered anodes 330 is preferably a heat resistant metal. For example, a tungsten rod or a stainless rod is preferably used, but not limited thereto. Rod anode 332 having a diameter of about 1 mm can be exemplified. A dielectric covered mesh anode having a ceramic covered wire diameter of 2 mm and a metal wire diameter of 0.4 mm, and having about 10 mesh/inch can be exemplified.

Examples of dielectric 333 which covers rod anode 332 include ceramics. Covering on rod anode 332 can be performed by, for example, sputtering. Here, although rod anode 332 is described to be covered, rod anode 332 may be configured to be inserted into a ceramic pipe by using the ceramic pipe as dielectric 333.

Planar metal fiber mesh cathode 331 is preferably heat resistant metal mesh (for example, wire diameter: 20 μm, porosity: 83%, thickness: 1.3 mm). For example, a tungsten mesh or a tungsten alloy mesh is preferably used, but not limited thereto. The openings of the mesh may have such a size that, for example, particulate matter 6' of 0.1 μm does not easily pass the mesh and the mesh can capture. As illustrated, planar metal fiber mesh cathode 331 is held by retention member 336 of electrically insulating quadrangular prism pipe 100.

Since this planar metal fiber mesh cathode 331 can capture particulate matter 6', particulate matter 6' is provided with sufficient discharge energy while particulate matter 6' introduced into silent discharge area A3 is captured by the mesh structure. As a result, efficient combustion can be realized. After the combustion, particulate matter 6' becomes combustion gas 350 and passes through the mesh and is discharged from discharge portion 9 as exhaust gas 151.

Namely, negatively charged particulate matter 6' in the particulates which pass through dielectric covered anode 330 is electrostatically attracted to dielectric covered anode 330, and passes there at a reduced speed to introduce into silent discharge area A3. Since particulate matter 6' which has introduced into silent discharge area A3 is electrostatically repelled by planar metal fiber mesh cathode 331, the speed of particulate matter 6' is further reduced and the deposition effect to the mesh is increased. Further, since planar metal fiber mesh cathode 331 is formed by a mesh which does not allow particulate matter 6' to pass through irrelative of electrification, particulate matter 6' is deposited on the mesh. As a result, charged particulate matters and non-charged particulate matters are deposited on the surface of the mesh, receive much discharge energy and can be efficiently combusted.

Since power source unit 4 is the same as in the first and the second embodiment, the description thereof is omitted.

As described above, in the third embodiment of combustion device 10C for combusting particulate matters, the particulate is deposited on the mesh by trapping effect of planar metal fiber mesh, and further, part of particulate matter 6' in the gas flow has negative space charge 322 gathered around planar mesh anode 321. Particulate matter 6' having negative space charge 322 proceeds with maintaining the negatively-charged state, passes through dielectric covered anode 330 to be introduced into silent discharge area A3, and repelled by the electrostatic force of silent discharge area A3. Particulate matter 6' is deposited on planar metal fiber mesh cathode 331 which constitutes silent discharge area A3 by these two effects. As a result, particulate matter 6' obtains much discharge energy and can be efficiently combusted.

DESCRIPTION OF THE REFERENCE NUMERALS

1 Internal combustion engine
2 Exhaust port
3 Muffler
4 power source unit
5 particulate matter-containing gas

6 Particulate matter
6' Particulate matter having negative space charge
8 Introduction portion
9 Discharge portion
10 Combustion device for combusting particulate matters
10A Combustion device in the first embodiment
10B Combustion device in the second embodiment
10C Combustion device in the third embodiment
11,21,31 Charging unit
15,25,35 Electric discharge unit
A1, A2, A3 Silent discharge area
100 insulation pipe (circular pipe, insulating quadrangular prism pipe, ceramic insulation pipe)
101, 101A, 101B Gas flow conversion member
102 Inflow ports
103 Outflow port
104 Flow channel
105 Propeller shaft
106 Blade
107 Spiral flow
121 Ring anode
122 Negative space charge
124 Supporting member
125 Ring member
131 Cylindrical cathode
132 Cylindrical dielectric
133 Cylindrical metal fiber mesh anode
134 Insulation pipes
135 Particulate matter in combustion
141 High voltage and high frequency generator
142 Power source
151 Combusted gas
201 Pipe
221 Planar mesh anode
222 Negative space charge
233 Cylindrical metal fiber mesh anode
234 Cylindrical dielectric (ceramic pipe)
235 Cylindrical cathode
236 Supporting bolts
237 Circular plate-like flow channel control member
238 Pillar
241 Insulation pipe
242 Coaxial ring
243 Flow channel
244 End portion
250 Combusted gas
301 Pipe
321 Planar mesh anode
322 Negative space charge
330 Dielectric covered anode
331 Planar metal fiber mesh cathode
332 Rod anode
333 Dielectric
335 Deposited Particulate matter
336 Retention member holding cathode
341 Pipe
350 Combusted gas

The invention claimed is:

1. A combustion device for combusting particulate matters comprising:

an introduction portion which connects to an exhaust port of an internal combustion engine and is used to introduce a particulate matter-containing gas discharged from the exhaust port;

a charging unit which is provided on the downstream side of the introduction portion, and in which all or part of the particulate matters are negatively charged by bringing the particulate matter-containing gas into contact with;

an electric discharge unit which is provided in an insulation pipe which is connected to the downstream side of the charging unit, and in which the particulate matters, all or part of which are negatively charged, are introduced into a silent discharge area, the silent discharge area being generated between an anode and a cathode;

a discharge portion which is connected to the insulation pipe at the downstream side of the electric discharge unit and which discharges the combusted gas; and a power source unit which applies an electric field to the charging unit and the electric discharge unit, and wherein the electric discharge unit includes:

a planar metal fiber mesh cathode provided orthogonal to a flow channel of the particulate matter-containing gas; and an anode which is spaced from the planar metal fiber mesh cathode at predetermined gap on the upstream side of the planar metal fiber mesh cathode, and faces to the planar metal fiber mesh cathode, the predetermined gap being a silent discharge area.

2. A device for combusting particulate matters, comprising:

an introduction portion which connects to an exhaust port of an internal combustion engine and is used to introduce a particulate matter-containing gas discharged from the exhaust port;

a charging unit which is provided on the downstream side of the introduction portion, and in which all or part of the particulate matters are negatively charged by bringing the particulate matter-containing gas into contact with;

an electric discharge unit which is provided in an insulation pipe which is connected to the downstream side of the charging unit, and in which the particulate matters, all or part of which are negatively charged, are introduced into a silent discharge area, the silent discharge area being generated between an anode and a cathode; and a discharge portion which is connected to the insulation pipe at the downstream side of the electric discharge unit and which discharges the combusted gas; and a power source unit which applies an electric field to the charging unit and the electric discharge unit, wherein the introduction portion has a gas flow conversion member which changes the flow of the particulate matter-containing gas to a spiral flow;

the charging unit has a ring anode provided along the internal circumference of the pipe where the spiral flow flows; and the electric discharge unit has a cylindrical cathode provided on inner wall of the insulation pipe, a cylindrical dielectric provided inside the cathode and a cylindrical mesh anode is spaced from the cylindrical dielectric at predetermined gap on the inside of the cylindrical dielectric.

3. A combustion device for combusting particulate matters, comprising:

an introduction portion which connects to an exhaust port of an internal combustion engine and is used to introduce a particulate matter-containing gas discharged from the exhaust port;

a charging unit which is provided on the downstream side of the introduction portion, and in which all or part of the particulate matters are negatively charged by bringing the particulate matter-containing gas into contact with;

an electric discharge unit which is provided in an insulation pipe which is connected to the downstream side of the charging unit, and in which the particulate matters, all or part of which are negatively charged, are introduced into a silent discharge area, the silent discharge area being generated between an anode and a cathode; and a discharge portion which is connected to the insulation pipe at the downstream side of the electric discharge unit and which discharges the combusted gas; and a power source unit which applies an electric field to the charging unit and the electric discharge unit, wherein the charging unit has a planar mesh anode provided orthogonal to a flow channel of the particulate matter-containing gas;

the electric discharge unit has:

a cylindrical cathode spaced from the inner wall of the insulation pipe at predetermined gap;

a cylindrical dielectric provided inside the cathode;

a cylindrical mesh anode spaced from the cylindrical dielectric on the inside of the cylindrical dielectric; and a gas flow conversion member which introduces the particulate matters charged by the planar mesh anode into the silent discharge area between the cylindrical dielectric and the cylindrical mesh anode.

4. The combustion device for combusting particulate matters according to claim 1, wherein openings of the planar metal fiber mesh cathode is smaller in size than the particulate matters.

5. A method for combusting particulate matters comprising:

negatively charging all or part of particulate matters included in a particulate matter-containing gas discharged from an internal combustion engine;

electrically attracting or repelling the negatively charged particulate matters in order to reduce the speed of the negatively charged particulate matters;

increasing retention time for the particulate matters to be retained in a silent discharge area in order to extend time for applying discharge energy at the silent discharge area; and combusting the particulate matters in the silent discharge area, wherein the silent discharge area is formed of a planar metal fiber mesh cathode and an anode, the planar metal fiber mesh cathode being provided orthogonal to a flow channel of the particulate matter-containing gas, the anode being spaced from the planar metal fiber mesh cathode at predetermined gap on the upstream side of the planar metal fiber mesh cathode, and faces to the planar metal fiber mesh cathode.

6. The method for combusting particulate matters according to claim 5, wherein the anode has a mesh form and is provided on the downstream side of a flow channel of the particulate matter-containing gas, and the retention time is increased at the silent discharge area by electrostatically attracting the negatively charged particulate matters on the anode.

7. The method for combusting particulate matters according to claim 5, wherein the anode has a mesh form and is provided on the downstream side of a flow channel of the particulate matter-containing gas in order to capture the negatively charged particulate matters, and the retention time is increased at the silent discharge area by attracting and depositing the negatively charged particulate matters on the anode.

8. The method for combusting particulate matters according to claim 5, wherein the anode has a mesh form and is provided on the downstream side of a flow channel of the particulate matter-containing gas, and the retention time is increased at the silent discharge area by electrostatically repelling the negatively charged particulate matters by the mesh cathode.

* * * * *